United States Patent [19]

Hobbs

[11] Patent Number: 4,741,451

[45] Date of Patent: May 3, 1988

[54] EASY OPEN CONTAINER

[75] Inventor: Douglas H. Hobbs, Seabrook, Tex.

[73] Assignee: Shell Oil Company, Houston, Tex.

[21] Appl. No.: 892,231

[22] Filed: Jul. 31, 1986

[51] Int. Cl.[4] ..... B65D 41/32

[52] U.S. Cl. ..... 220/271; 220/270; 220/285

[58] Field of Search ..... 220/269, 270, 271, 345, 220/260, 281, 285, 254, 255, 284, 363; 229/43

[56] References Cited

U.S. PATENT DOCUMENTS 4,099,642 7/1978 Nergard ..... 220/254

*Primary Examiner*—Stephen Marcus

*Assistant Examiner*—Nova Stucker

[57] ABSTRACT

This invention is an easy open device for a container which is made up of a closure block which is positioned contiguous to and under a lid of a container, where a substantial portion of the closure block is beneath an aperture in the lid of the container and an opening actuator which is placed on top of or in and at least temporarily adhered to the closure block so that a substantial portion of the opening actuator is beneath the aperture in the lid of the container, and where a pull tab of the opening actuator protrudes through a second aperture in the lid of the container and which may be fastened in some suitable manner to the lid of the container.

12 Claims, 3 Drawing Sheets

FIG. 1
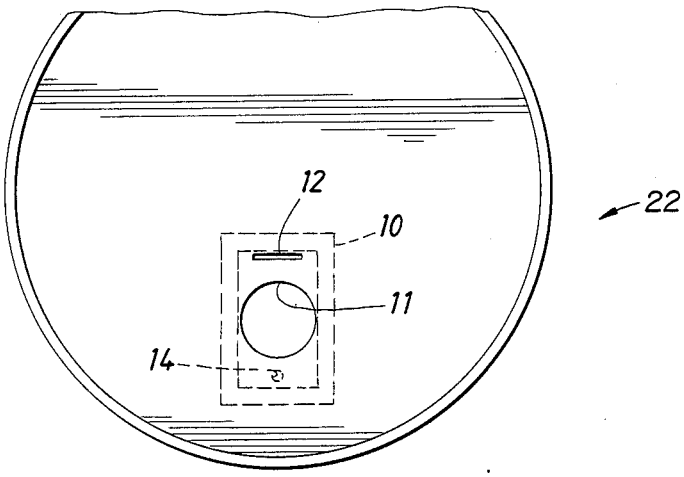
FIG. 2
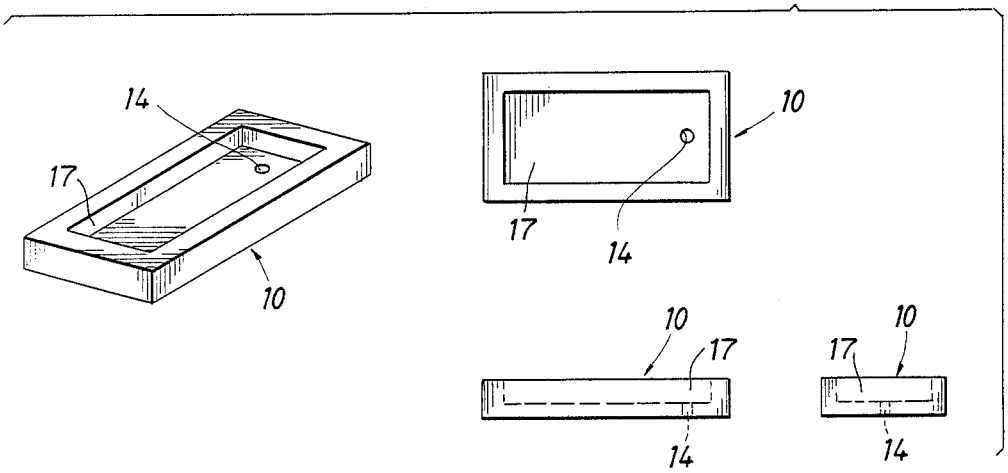
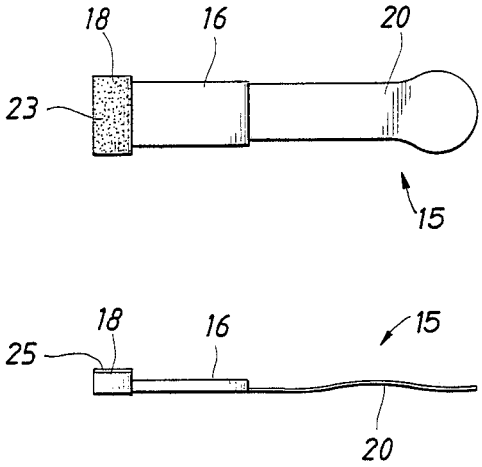
FIG. 3

FIG. 8
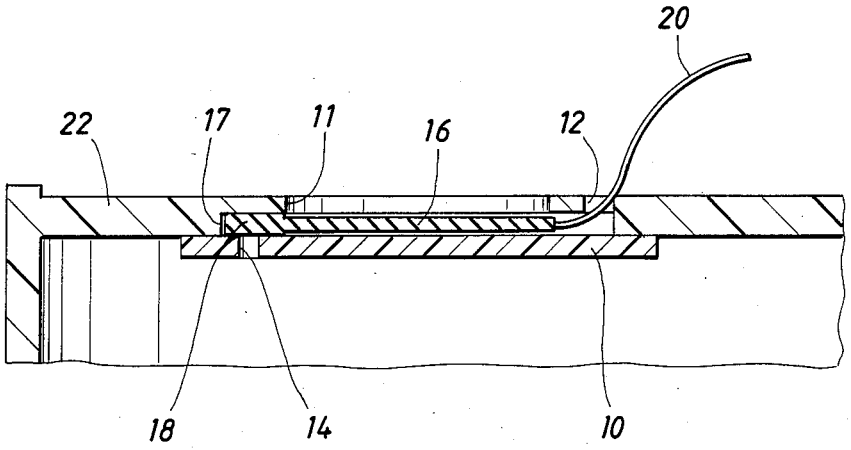
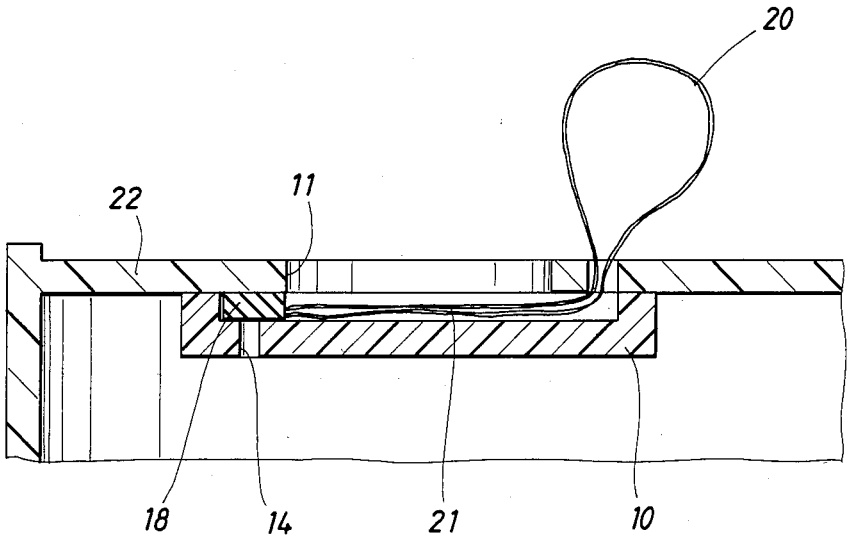
FIG. 9

EASY OPEN CONTAINER

BACKGROUND OF THE INVENTION

The present invention relates to any easy open device for various containers such as pressure vessels, tanks, hot water heaters and the like.

Many closure and opening devices for containers are known. Many aluminum carbonated beverage cans, for example, have indented, pull top openings or tabs. Some containers are opened by twisting off a cap. Others are opened by tearing off an adhesive foil pull tab. Others are opened by tearing a plastic strip from around the neck of the container.

There has been a need for an easy open device for containers, in particular for carbonated pressurized containers, where the opening of the container action is accomplished in one motion, and where there are no extra "pieces" of the opening device which must either be thrown away or which must be inserted, even though dirty, into the container during consumption. In addition, an easy open device which is sanitary and which is particularly adaptable to a thermoplastic container, or at least a thermoplastic top or lid, is needed.

SUMMARY OF THE INVENTION

This invention is an easy open device for a container which is made up of a lid, a closure block which is positioned contiguous to and under the lid of the container, where a substantial portion of the closure block is beneath an aperture in said lid of the container and an opening lever which is placed on top of or in the closure block. A seal area of the opening lever is at least temporarily adhered to the closure block or the lid of the container, so that a substantial portion of the opening lever is beneath the aperture in the lid of the container, and where a pull tab of the opening level protrudes through a second aperture in the lid of the container and may be fastened in some suitable manner to the lid of the container.

BRIEF DESCRIPTION OF THE DRAWINGS

FIG. 1 is a top view of the lid of a container which has the easy open device of this invention.

FIG. 2 shows the closure block.

FIG. 3 shows the opening actuator from a side and top view, including a means adhering the seal area to the lid portion.

FIG. 8 shows a cross-sectional view of the lid of a container with the recess portion of the closure block now a part of the lid.

FIG. 9 shows a cross-sectional side view of the closure block and opening actuator with two flexible connections.

DETAILED DESCRIPTION OF THE INVENTION

Figure 4:
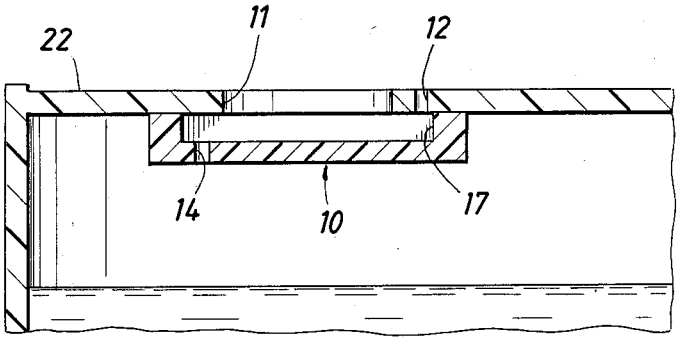
FIG. 4 shows a cross-sectional side view of the closure block without the opening actuator.

FIG. 1 shows a top view of the lid 22 of the container with the easy open device of this invention. Closure block 10 is seen with slit 12 in lid 22. Slit 12 may be any type of opening or aperture in lid 22.

FIG. 2 shows closure block 10 from top and side views. Aperture 14 in closure block 10 is located in closure block 10 to allow venting of any carbonation, gas pressure or pressurized liquids within the container when the container is opened.

In FIG. 3, the opening actuator 15 (the opening lever 16, seal area 18 and pull tab 20) are shown from a side and top view. Opening lever 16 is located within recess 17 of closure block 10. Seal area 18 of opening actuator 15 is provided in some manner so as to stick or remain between closure block 10 and lid portion 22 over aperture 14. There are various means by which this may be accomplished. The seal area 18 of opening actuator 15 may be made of a hard material, an elastomeric material, or a material coated with adhesive 23 which will remain between closure block 10 and lid portion 22, or a thin adhesive coated membrane (tape) 25 may be used between seal area 18 and lid portion 22. It is not even necessary that seal area 18 and closure block 10 require an elastomeric material, adhesive coated material or adhesive coated membrane as long as seal area 18, closure block 10 and lid 22 are contiguous to each other prior to opening the container.

Opening actuator 15 is provided with a pull tab 20, which pull tab is flexible at least from the end of opening actuator 15 through slit 12, which is inserted through slit 12 of closure block 10. Opening actuator 15 may be made of one piece of thermoplastic material, although it need not be.

The closure block 10 and opening actuator 15 is preferably made of a thermoplastic, such as polypropylene, polycarbonate and polyethylene, etc. Most preferred is polypropylene. The lid 22 of the container may be made of a thermoplastic as well. The opening device, lid 22, and container however, may be made of metal, or some other suitable material.

FIGS. 4, 5, 6 and 7 illustrate the opening mechanism of the easy open device of this invention.

In FIG. 4, closure block 10 is positioned adjacent and contiguous to the bottom portion of lid 22 of the container so that closure block 10 is positioned directly underneath opening port 11 and slit 12. Closure block 10 is attached in some manner at least temporarily to lid 22, and if necessary a pressure seal is formed to keep the carbonation, gas pressure, or pressurized lids in the container. It may be attached, for example, by adhesive or by some mechanical means.

Figure 5:
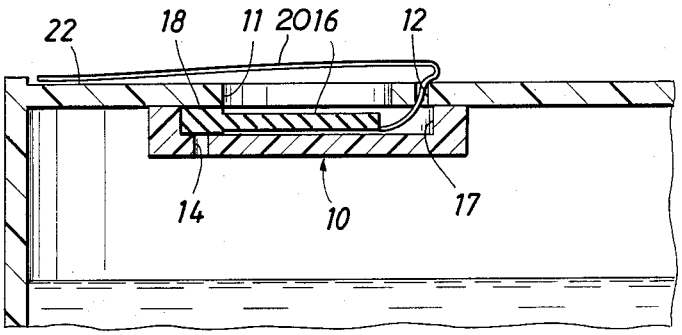
FIG. 5 shows a cross-sectional side view of the closure block with the opening actuator in place.

In FIG. 5, opening lever 16 is placed inside of recess 17 of closure block 10 so that seal area 18 of opening lever 16 is in contact with closure block 10 and lid 22. Pull tab 20 emerges through slit 12 of container 22. Aperture 14 in closure block 10 serves to release any carbonation, gas pressure or pressurized liquids within the container when the container is opened. The end of flexible pull tab 20 may then be folded down on top of or attached in some manner to the lid 22 of the container, although this is not necessary. Preferably, pull tab 20 is attached over opening port 11 and surrounding area for sanitary drinking reasons. The portion of flexible pull tab 20 which is over opening port 11 and the surrounding area is of a sufficient size so that the pull tab 20 does not fall into the container upon opening said container.

Figure 6:
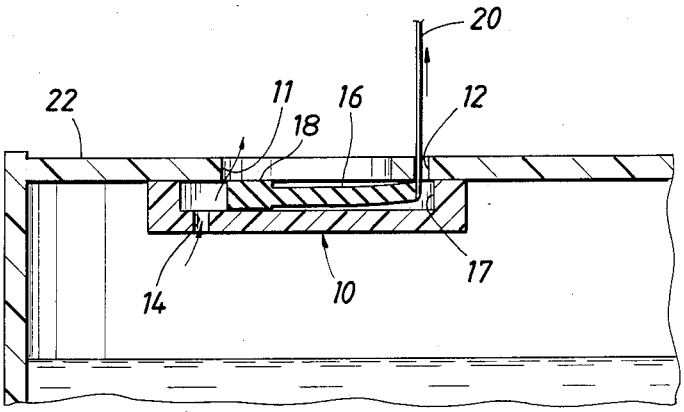
FIG. 6 shows a cross-sectional side view of the opening action as the opening actuator is pulled.

In FIG. 6, flexible pull tab 20 is pulled in a generally upward manner which causes seal area 18 to move away from aperture 14, thus releasing any carbonation, gas pressure, or pressurized liquids might be in the container.

Figure 7:
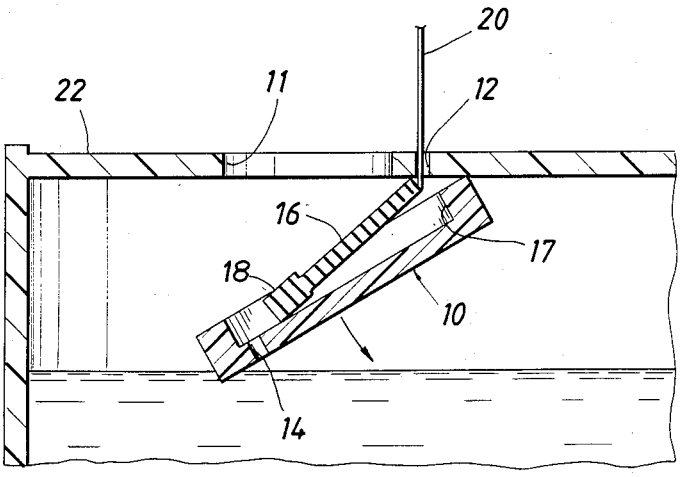
FIG. 7 shows a cross-sectional view of the closure and opening device which is substantially open.

In FIG. 7, after any carbonation, gas pressure or pressurized liquids have been released, the motion of opening lever 16 can now force closure block 10 away from the lid 22 of the container and opening lever 16, thus fully revealing the opening port 11 of the lid portion 22 of the container. The sterile closure block 10 may fall into the contents of the container. Opening port 11 is left revealed for appropriate use. Sterile opening lever 16 remains within the container.

In FIG. 8, the lid 22 of container is shown with recess 17 of closure block 10 as a part of lid 22. Thus the lid 22 and the recess 17 of closure block 10 may be manufactured as one piece. The closure block 10 is now flat and non-recessed, albeit containing aperture 14.

In FIG. 9, opening actuator 15 comprises a pull tab 20, seal 18 and two flexible connections 21 where one flexible connection 21 is attached to seal area 18 and one flexible connection is attached to closure block 10 adjacent to but not covering aperture 14. Pull tab 20 is pulled in a generally upward motion, seal area 18 moves away from aperture 14, thus releasing any carbonation, gas presure, or pressurized liquid. While pull tab 20 is continually pulled, closure block 10 is slid across aperture 11, thus revealing aperture 11 for use.

The dimensions of closure block 10 should be such as to provide a sufficient seal surface with the inside of container opening around opening port 11. This may vary according to the size of the container being used. The contents of the container, and any carbonation, gas pressure or pressurized liquids are prevented from escapting by the closure block 10 and seal area 18.

The opening device may be made by any suitable method, for example, by injection molding, thermoforming, die cutting, stamping, machining, casting or the like.

The easy open device may be located in areas other than the lid 22 of the container. For example, the easy open device could be located on the sides of hot water heaters, pressure tanks in industrial use, etc.

Other materials and variations may be apparent to those of ordinary skill in the art.

What is claimed is:

1. An easy open device for a container which comprises:

a container lid; a closure block which is positioned contiguous to and under said lid of said container, where a substantial portion of said closure block is beneath an aperture in said lid of said container; and an opening actuator which is at least temporarily adhered to said closure block so that a substantial portion of said opening actuator is beneath said aperture in said lid of said container, and where a pull tab end of said opening actuator protrudes through a second aperture in said lid of said container, wherein said closure block contains an aperture positioned at one end of said closure block so that a seal area of said opening actuator covers said aperture in said closure block until said actuator is pulled, thereby venting any carbonation, gas pressure or pressurized liquid within said container through said aperture in said closure block.

2. The easy open device of claim 1, wherein siad device is made of a thermoplastic material.

3. The easy open device of claim 1, which includes a means for adhering said closure block to said seal area of said opening actuator.

4. The easy open device of claim 1, wherein said pull tab end of said opening actuator is fastened to said lid of said container.

5. A thermoplastic easy open device for a non vacuum container which comprises a closure block which is positioned contiguous to and under the container lid of said container, where a substantial portion of said closure block is beneath an aperture in said lid of said container, and where said closure block contains an aperture at one end of said closure block; and an opening actuator which is placed on top of or in said closure block so that a substantial portion of said opening actuator is beneath said aperture in said lid of said container, wherein a means for adhering said closure block with said seal area of said opening actuator is included, and where a pull tab of said opening actuator protrudes through a second aperture in said lid of said container and is fastened a seal area of said opening actuator covers said aperture in said closure block until said actuator is pulled, thereby venting any carbonation, gas pressure or pressurized liquid within said container through said aperture in said closure block.

6. A thermoplastic lid for a non vacuum container which comprises a closure block which is positioned contiguous to and under said lid of said container, where a substantial portion of said closure block is beneath an aperture in said lid of said container, and where said closure block contains an aperture at one end of said closure block; and an opening actuator which is placed on top of said closure block so that a substantial portion of said opening actuator is beneath said aperture in said lid of said container, wherein a means for adhering said closure block to said seal area of said opening actuator is included, and where a pull tab of said opening actuator protrudes through a second aperture in said container lid of said container.

7. The lid in claim 6, wherein said pull tab end of said opening actuator is fastened to said lid portion of said container.

8. The lid in claim 6, wherein said closure block contains an aperture positioned at the end of said closure block so that a seal area of said opening actuator covers said aperture in said closure block until said actuator is pulled, thereby venting any carbonation, gas pressure or pressurized liquid within said container through said aperture in said closure block.

9. A thermoplastic container lid for a pressure container which comprises a closure block which is positioned contiguous to and under said lid of said container, where a substantial portion of said closure block is beneath an aperture in said lid of said container, and where said closure block contains an aperture at one end of said closure block; and an opening actuator which is placed on top of said closure block so that a substantial portion of said opening actuator is beneath said aperture in said lid of said container, wherein a means for adhering said closure block to said seal area of said opening actuator is included, and where a pull tab of said opening actuator protrudes through a second aperture in said lid of said container.

10. The thermoplastic lid of claim 9, wherein said pull tab of said opening actuator is fastened to said lid of said container.

11. The lid in claim 9, wherein said closure block contains an aperture positioned at the end of said closure block so that a seal area of said opening actuator covers said aperture in said closure block until said actuator is pulled, thereby venting any carbonation, gas pressure or pressurized liquid within said container through said aperture in said closure block.

12. A thermoplastic container lid for a pressure container which comprises a closure block which is positioned contiguous to and under said lid of said container, where a substantial portion of said closure block is beneath an aperture in said lid of said container, and where said closure block contains an aperture at one end of said closure block; and an opening actuator which is placed on top of said closure block so that a substantial portion of said opening actuator is beneath said aperture in said lid of said container, wherein a means for adhering said closure block to said seal area of said opening actuator is included, and where a pull tab of said opening actuator protrudes through a second aperture in said lid of said container, wherein said pull tab of said opening actuator is fastened to said lid of said container and wherein said closure block contains an aperture positioned at the end of said closure block so that a seal area of said opening actuator cover said aperture in said closure block until said actuator is pulled, thereby venting any carbonation, gas pressure or pressurized liquid within said container through said aperture in said closure block.

* * * * *